US005828012A

United States Patent [19]

Repolléet al.

[11] Patent Number: 5,828,012

[45] Date of Patent: Oct. 27, 1998

[54] PROTECTIVE COVER ASSEMBLY HAVING ENHANCED ACOUSTICAL CHARACTERISTICS

[75] Inventors: Damian I. Repollé, Newark, Del.; Frank S. Principe, Landenberg, Pa.

[73] Assignee: W. L. Gore & Associates, Inc., Newark, Del.

[21] Appl. No.: 864,476

[22] Filed: May 28, 1997

Related U.S. Application Data

[60] Provisional application No. 60/018,721 May 3, 1996.

[51] Int. Cl.[6] ..... G10K 11/00

[52] U.S. Cl. ..... 181/175

[58] Field of Search ..... 181/141, 150, 181/175, 199, 151; 381/153, 188, 189, 205

[56] References Cited

U.S. PATENT DOCUMENTS

| | | | |
|---|---|---|---|
| 3,674,108 | 7/1972 | Beatty . | |
| 3,987,258 | 10/1976 | Tsutsui et al. . | |
| 4,071,040 | 1/1978 | Moriarty . | |
| 4,071,111 | 1/1978 | Croup . | |
| 4,949,386 | 8/1990 | Hill . | |
| 4,987,597 | 1/1991 | Haertl . | |
| 5,222,050 | 6/1993 | Marren et al. . | |
| 5,412,162 | 5/1995 | Kindel | 181/150 |
| 5,420,570 | 5/1995 | Leitten et al. . | |

FOREIGN PATENT DOCUMENTS

| | | |
|---|---|---|
| 24 04 943 | 8/1975 | Germany . |
| 7-289856 | 11/1995 | Japan . |

OTHER PUBLICATIONS

Article—Joseph Pizzirusso, "The Acoustics of Plastic Foam", Machine Design, Jan. 8, 1981, vol. 53, pp. 135–139.

*Primary Examiner*—Khanh Dang
*Attorney, Agent, or Firm*—Gary A. Samuels

[57] ABSTRACT

A sound-transmissive cover assembly which provides protection from the ambient environment to transducers such as microphones, loudspeakers, buzzers, ringers, and other delicate devices; and across which sound energy can pass with very low attenuation. The cover assembly has a protective membrane layer and a porous support material layer which are selectively bonded together at least in the outer region near their edges. An inner unbonded region surrounded by the bonded outer region is provided so that the protective membrane and porous support layer can vibrate or move independently in response to acoustic energy passing through them. An embodiment of the assembly includes at least one acoustic gasket attached to one or both of the layers so as to not impede independent movement of the layers.

17 Claims, 3 Drawing Sheets

PROTECTIVE COVER ASSEMBLY HAVING ENHANCED ACOUSTICAL CHARACTERISTICS

CROSS REFERENCE TO RELATED APPLICATIONS

This application claims the benefit of Provisional Application Ser. No. 60/018,721, filed May 31, 1996.

FIELD OF THE INVENTION

The present invention generally relates to an acoustic cover assembly which provides minimal sound attenuation for a transducer apparatus, such as but not limited to loudspeakers, microphones, ringers, and buzzers, which are employed in such devices as, but not limited to, cellular, cordless, or wired telephones, radios, and personal pagers. Additionally, the present invention relates to novel combinations of acoustic cover assemblies and acoustic gaskets.

BACKGROUND OF THE INVENTION

Modern electronic communication devices, such as cellular telephones, have been designed with housings which have very small openings or apertures located over transducer devices. Such a design provides minimal protection against incidental exposure to water, such as an occasional rain drop, for example. However, this design excessively attenuates a transducer's effectiveness and sound quality, and can not resist liquid entry if the electronic device is submersed in water or exposed to rain.

To date, various electronic communication devices have employed a porous, non-woven or woven fabric as a protective cover for transducer devices. In this regard, it is well established that the amount of sound attenuation attributed to a porous material is a function of the material's resistance to air flow, of which the following are controlling parameters: material thickness, fiber diameter, effective pore size, and pore volume. Although such porous materials may have operated with limited success in various applications, such materials are relatively ineffective in protecting transducer devices from damage due to liquid entry into the electronic device. These porous fabric materials have relatively large pore sizes which permit liquids to easily pass therethrough. It has been discovered that treating these porous fabric materials for water repellency does not permit immersion of these materials to significant depths because of the large pore structure of such materials.

U.S. Pat. No. 4,949,386 teaches an environmental protective covering system, comprising in part a laminated two-layer construction defined by a polyester woven or non-woven material and a micro-porous polytetrafluoroethylene membrane. The hydrophobic property of the micro-porous polytetrafluoroethylene membrane prevents liquid from passing through the environmental barrier system. Although the device of U.S. Pat. No. 4,949,386 may be effective in preventing liquid entry into an electronic device this laminated covering system causes excessive sound attenuation, which is unacceptable in modern communication electronics requiring excellent sound quality.

U.S. Pat. No. 4,987,597 teaches the use of a micro-porous polytetrafluoroethylene membrane as a covering for an electronic transducer. This membrane restricts liquid passage through the membrane, and does not significantly attenuate sound signals. Although such a covering may operate with varying degrees of success, it is desirable to support such a membrane with a substrate to provide for increased durability and resistance to physical degradation. However, to date, coverings employing micro-porous membranes in combination with support structures have had unacceptable attenuation losses.

U.S. Pat. No. 5,420,570 teaches the use of a non-porous film as a protective layer to protect an electronic device from liquid entry. Although it is well known that a non-porous film can provide excellent liquid entry resistance, such non-porous films suffer from relatively high sound transmission losses which excessively distort signals. These high losses result from the relatively thick and stiff non-porous films which are required to permit immersion to significant depths.

U.S. Pat. No. 4,071,040 teaches disposing a thin micro-porous membrane between two sintered stainless steel disks. Although such a construction may have been effective for its intended use in rugged military-type field telephone sets, such a construction is not desirable for use in modern communication electronic devices. The sintered metal disks are relatively thick and heavy, which is disadvantageous in the design of portable and compact communication electronic devices. Furthermore, disposing a micro-porous membrane between two stainless steel disks physically constrains the membrane, thereby limiting its ability to vibrate, which reduces sound quality by attenuating and distorting a sound signal being transmitted.

In addition to the foregoing, an acoustic gasket is desirable to maintain high sound quality in modern communication devices because of the limited power and sensitivity of the transducers used in such devices. More particularly, if no acoustic gasket is utilized between sound transducers (loudspeakers, ringers, microphones, etc.) and a communication device's housing, acoustic energy may leak into other regions of the housing, thereby attenuating and distorting the sound energy entering or leaving the housing. Such sound energy leakage can result in attenuation and distortion of sound projected out of the housing by transducers such as loudspeakers, ringers, etc., or of sound entering the housing to actuate a microphone. Acoustic gaskets can improve the effectiveness of loudspeakers by isolating them from the housing structure thereby converting more of the speaker's vibration energy directly into acoustic energy. Acoustic gaskets and materials are well known in the art, however, they are usually assembled into devices as separate components and thereby increase the cost and complexity of manufacturing the devices.

The foregoing illustrates limitations known to exist in present acoustic cover vents and gasket systems for electronic communication devices. Thus, it is apparent that it would be advantageous to provide an improved protective system directed to overcoming one or more of the limitations set forth above. Accordingly, a suitable alternative is provided including features more fully disclosed hereinafter.

SUMMARY OF THE INVENTION

The present invention advances the art of electronic devices, and techniques for acoustically sealing such devices, beyond which is known to date. In one aspect of the present invention, a sound-transmissive cover assembly is provided which comprises a protective membrane layer which is selectively bonded to a layer of porous support material. The layers are selectively bonded so that an inner unbonded region surrounded by an outer bonded region is formed. The unrestrained portions of the protective membrane and porous support layer are allowed to move or vibrate independently in response to acoustic energy passing therethrough, and thereby efficiently transmit sound energy across the assembly.

In another embodiment of the invention the protective cover assembly includes at least one acoustic gasket attached to a surface of the protective membrane layer and/or a surface of the porous support layer. The acoustic gasket is attached so as to permit independent movement of the protective membrane layer and porous support layer in the unbonded region.

BRIEF DESCRIPTION OF THE DRAWINGS

The foregoing summary, as well as the following detailed description of a preferred embodiment of the invention, will be better understood when read in conjunction with the appended drawings. For purposes of illustrating the invention, there is shown in the drawings an embodiment which is presently preferred. It should be understood, however, that the invention is not limited to the precise arrangement and instrumentality shown. In the drawings.

DETAILED DESCRIPTION OF THE INVENTION

Figure 1:
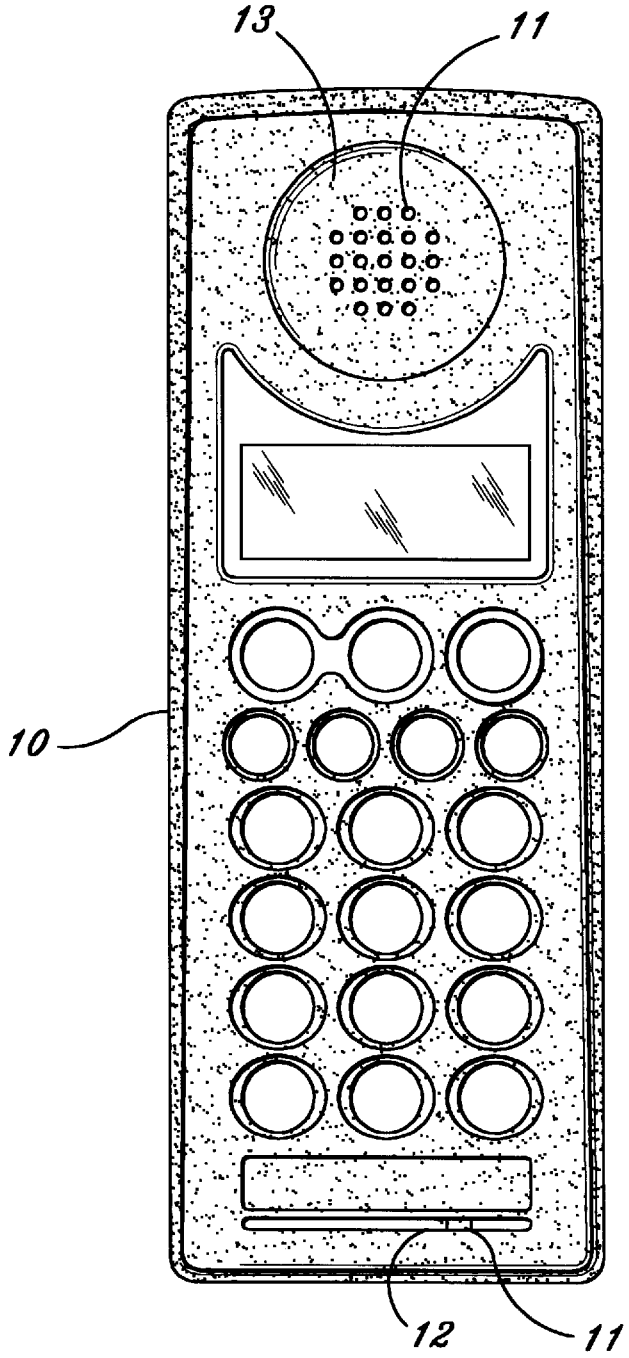
FIG. 1 is an external view of a conventional cellular phone front housing cover employing a protective cover assembly.

Referring now to the drawings, wherein similar reference characters designate corresponding parts throughout the several views, embodiments of the acoustic cover vents and gasket systems of the present invention are generally shown in a variety of configurations and dimensioned for use in a typical cellular phone application. As should be understood, the acoustic cover vents and gasket systems of the present invention may be used in any application requiring acoustic transparency and environmental protection, not limited to the applications illustrated and described herein.

As the term is used herein, "selectively bonded" and derivations thereof means to at least secure the edges and/or bond the layers together in the region near their edges while leaving a center portion substantially or totally non-laminated or unbonded so that the protective membrane layer and porous support layer are free to move relative to each other in the unbonded regions. For spans less than about 38 millimeters between the peripheral bonded regions, the center portion is generally unbonded. However, in cover assemblies for large areas where the spans between the peripheral bonded areas exceed about 38 millimeters, or for cover assemblies where exposure to loud noise is expected, it may be desirable to provide additional bonding at discrete well-separated points or along well-separated lines. The purpose for this is to reduce acoustic distortion across the assembly which may occur due to excessive movement, or flapping, of the protective membrane or support layers in the center portion.

By a porous material, as used herein, is meant a material having a structure defining interconnected pores and voids forming passages and pathways throughout the material, and defining an initial pore volume.

FIG. 1 is an external view of a conventional cellular phone front housing cover 10 having small openings or apertures 11 accessing a microphone mounting location 12 and a loudspeaker mounting location 13. The number, size, and shape of the apertures 11 may vary greatly. Alternate aperture designs include narrow slots or a variable number of circular apertures.

Figure 2:
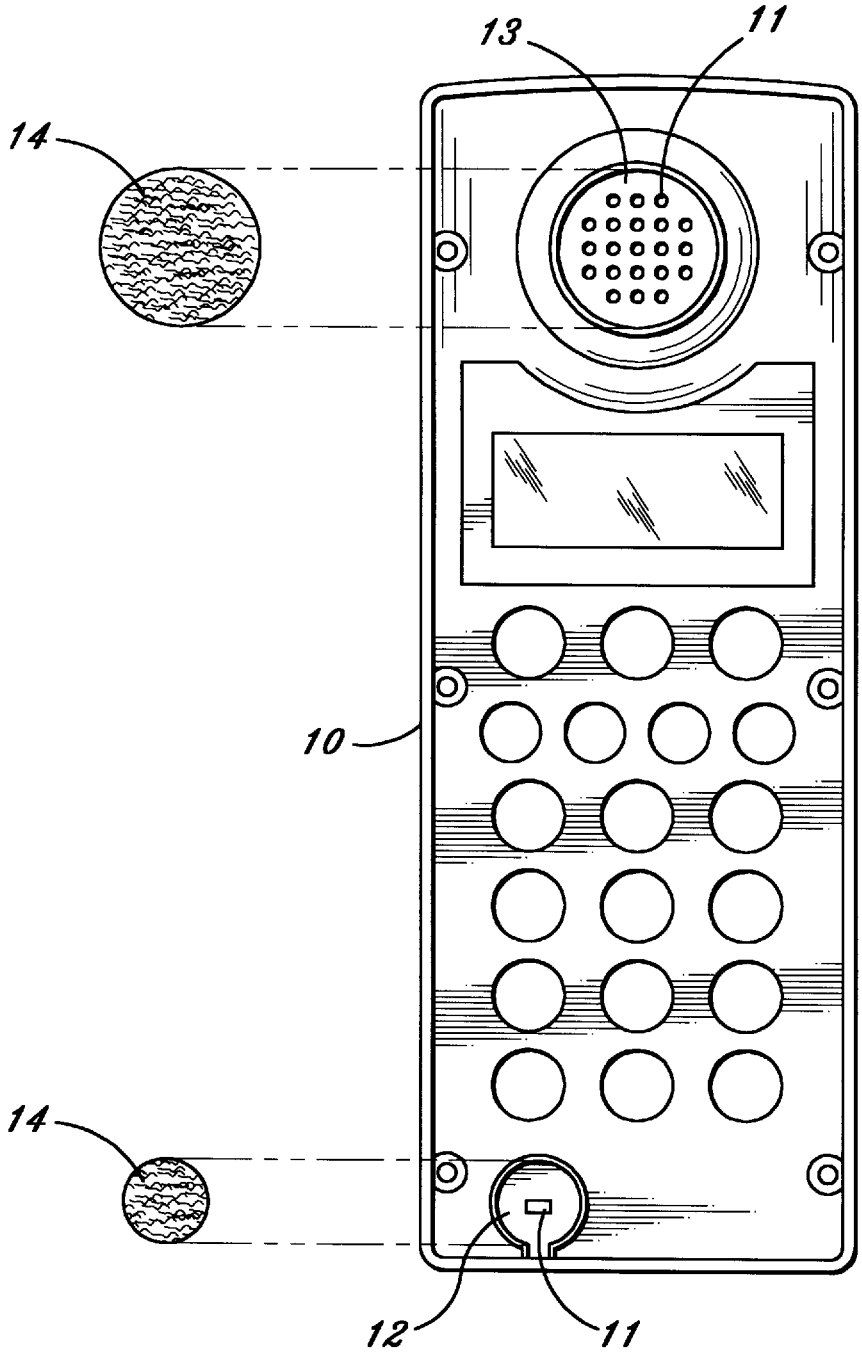
FIG. 2 is an internal view of the cellular phone front housing cover of FIG. 1.

FIG. 2 is an internal view of the front housing cover 10 illustrating the microphone mounting location 12 and the speaker mounting location 13. In addition, FIG. 2 illustrates generally a typical mounting location for protective vent covers 14 which are mounted in the microphone mounting location 12 and the speaker mounting location 13.

Figure 3:
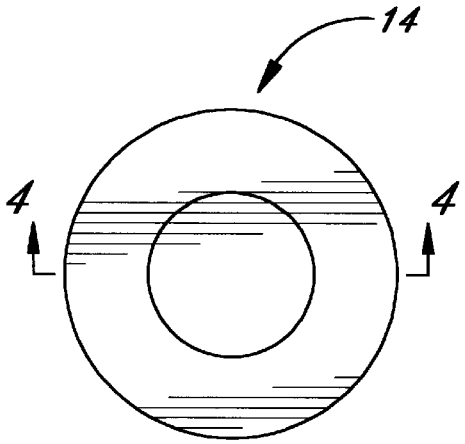
FIG. 3 is a plan view of an embodiment of a protective cover assembly of the present invention.
Figure 4:
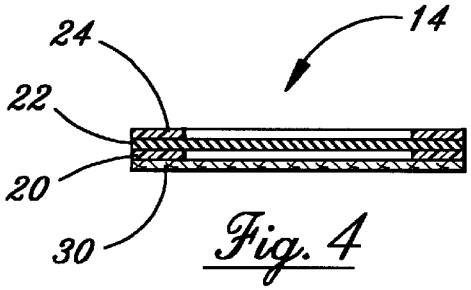
FIG. 4 is a sectional view of the protective cover assembly of FIG. 3.

FIGS. 3 and 4 illustrate an acoustically transparent embodiment of the protective cover assembly 14. By "acoustically transparent" is meant that sound energy passing through the assembly is attenuated by 1 db or less. As illustrated therein, the protective cover assembly 14 comprises a backing or support layer 30; a first adhesive layer 20; a protective membrane layer 22; and a second adhesive layer 24.

With reference to FIGS. 3 and 4, the protective membrane layer 22 is shown selectively bonded to the outer region of support layer 30 by an adhesive layer 20. The protective membrane 22 provides a barrier to dust and other particulates, is resistant to penetration by water or other aqueous fluids, and, to minimize sound loss therethrough, is preferably porous. However, a nonporous film can be used in instances where resistance to higher water pressures, or to nonaqueous liquids, has sufficient value that increased attenuation of the sound energy therethrough can be accepted.

The protective membrane can be made of many polymeric materials including, for example, polyamide, polyester, polyolefins such as polyethylene and polypropylene, or fluoropolymers. Fluoropolymers such as polyvinylidene fluoride (PVDF), tetrafluoroethylene-hexafluoropropylene copolymer (FEP), tetrafluoroethylene-(perfluoroalkyl) vinyl ether copolymer (PFA), polytetrafluoroethylene (PTFE), and the like, are preferred for their inherent hydrophobicity, chemical inertness, temperature resistance, and processing characteristics. Porous protective membranes, if not made of inherently hydrophobic materials, can have hydrophobic properties imparted to them, without significant loss of porosity, by treatment with fluorine-containing water-and oil-repellent materials known in the art. For example, the water- and oilrepellent materials and methods disclosed in U.S. Pat. Nos. 5,116,650, 5,286,279, 5,342,434, 5,376,441, and other patents, can be used.

A porous protective membrane should have the following properties: thickness in the range about 12 to 250 micrometers, preferably in the range 12 to 38 nominal pore size in the range 0.2 to 15 micrometers, preferably in the range about 1 to 5 micrometers; pore volume in the range 50 to 99 percent, preferably in the range 80 to 95 percent; air permeability in the range 0.05 to 30 Gurley-seconds, preferably in the range 0.5 to 3 Gurley-seconds; and water entry pressure resistance in the range 0.2 to 80 psi (1.4 to 552 kPa), preferably in the range 1 to 10 psi (6.9 to 69 kPa). Nonporous protective membranes should be as thin as possible, preferably 25 micrometers or less thick, more preferably in the range 1 to 12 micrometers thick.

In one embodiment of the present invention, protective membrane 22 is comprised at least in part of porous polytetrafluoroethylene (PTFE). As the term is used herein, porous polytetrafluoroethylene (PTFE) shall mean a material which may be prepared by any of a number of known processes, for example, by stretching or drawing processes, by paper-making processes, by processes in which filler materials are incorporated with the PTFE resin and which are subsequently removed to leave a porous structure, or by powder sintering processes. Preferably, the porous polytetrafluoroethylene material is porous expanded polytetrafluoroethylene having a microstructure of interconnected nodes and fibrils, as described in U.S. Pat. Nos. 3,953,566; 4,187,390; and 4,110,392, which are incorporated herein by reference, and which fully describe the preferred material and processes for making them. The porous PTFE membrane can contain pigments, such as a carbon black, or dyes by which it is colored for aesthetic purposes.

The backing or support layer 30 may be comprised of any suitable porous material that is strong enough to support the protective membrane 22, and yet is open enough to allow sound waves to pass therethrough without excessive attenuation or distortion. Examples of suitable materials for the support layer 30 include, but are not limited to, non-woven material, knit or woven fabrics, and mesh or scrims, made of polymeric materials such as those listed above. In a preferred embodiment, support layer 30 is a non-woven polyester material with a thickness ranging from about 100 to about 1000 micrometers (0.004" to 0.040"), preferably in a range from about 200 to about 400 micrometers (0.008" to 0.016"); with a basis weight of 0.5 to 10 oz/yd$^2$, preferably in the range about 1.0 to 3.0 oz/yd$^2$.

The purpose of the porous support layer 30 is to provide mechanical support to the protective layer 22 in the event of unexpected forces applied against the protective layer. For example, against hydrostatic pressure forces on the assembly when the device in which the assembly is mounted is immersed in water, as might occur, for example, if a cellular telephone is dropped into a swimming pool, or overboard from a boat. The support layer 30 provides the further benefit of making it possible to use thinner, or weaker, protective membranes 22 which improves sound transmission through the cover assembly 14. The support layer 30 is bonded to the protective membrane 22 to form a unitary cover assembly 14 which is much more easily handled in manufacturing and assembly processes than are the components separately. As noted earlier, the prior art suggests a laminated construction to satisfy these needs, however, such a construction excessively attenuates and distorts sound energy passing therethrough.

The inventors have discovered that by selectively bonding the protective membrane layer 22 to the porous support layer 30 to form a unitary cover assembly 14, sound energy can pass through the assembly with virtually no attenuation whilst still obtaining support and handling benefits. The protective membrane layer and porous support layer are bonded or laminated together only in selected areas or regions, so that large unbonded areas between the layers are provided. Thus, the protective membrane layer and porous support layer are free to move or vibrate independently from each other in the unbonded regions in response to acoustic energy. The protective membrane layer 22 and porous support layer 30 are generally superposed and positioned so that their edges are coextensive, although such need not always be the case. The protective membrane and porous support layer are bonded together at least in the peripheral regions near their edges, so as to form and surround one or more inner unbonded region(s) within the outer bonded region. For cover assemblies in which the span defined by the inner perimeter of the bonded region is about 38 millimeters (1 ½ inches) or less, there is generally no need for additional bonding of the layers. In cases where the span is greater than about 38 millimeters it may be desirable to provide additional bond sites at discrete widely separated points to prevent excessive movement or flapping of the layers. For very large cover assemblies it may be more convenient to use widely separated bond lines instead of discrete bond points. The need for additional bonding of the layers of the cover assembly is dependent on the shape of the area or device to be covered as well as by the size of the assembly. Thus, some experimentation may be needed to establish the best method and pattern of additional bonding to optimize acoustic performance of the cover assembly. In general, for all sizes, it is preferred that the area of the bonded region(s) be minimized, to the extent permitted by the mechanical and acoustic requirements of the cover assembly, and the area of the open unbonded region(s) be maximized.

The protective membrane layer 22 and porous support layer 30 may be bonded by many methods known in the art. For example, they can be fusion bonded by application of heat and pressure between platens or rolls, or other fusion methods such as heat welding, ultrasonic welding, RF welding, and the like. The protective membrane layer and porous support layer can also be bonded by adhesives using methods and materials selected from many known in the art. The adhesives can be thermoplastic, thermosetting, or reaction curing types, in liquid or solid form, selected from the classes including, but not limited to, acrylics, polyamides, polyacrylamides, polyesters, polyolefins, polyurethanes, and the like. The adhesive can be applied by screen printing, gravure printing, spray coating, powder coating, and the like, or in forms such as a web, mesh, or pressure-sensitive tape.

The cover assembly 14 can be used to protect a transducer device located in a rigid enclosure or housing such as a cellular telephone, portable radio, pager, loudspeaker enclosure, and the like. The cover assembly is designed with consideration of the dimensional characteristics and acoustic properties of the transducer first and secondly with respect to the sound transmission apertures of the housing. This is particularly important in sizing the unbonded area of the cover assembly. It was observed that the amount of open (not bonded) area significantly affected sound transmission values into or out of a housing. It was surprising to learn that sound energy losses were significantly reduced by increasing the amount of unbonded area of the cover assembly, even though the area defined by the sound transmission opening or apertures in the housing was very small. Although an exact relationship has not been established, it is felt that the unbonded area of the cover assembly should be at least equal to the open area of the apertures in the device's housing near which the cover assembly is located, and preferably, that the unbonded area of the cover assembly should be much larger than the area of the apertures in the housing near which the cover assembly is located.

In another embodiment of the invention the protective cover assembly includes at least one acoustic gasket attached to a surface of the protective membrane layer and/or a surface of the porous support layer. The acoustic gasket is attached so as to permit independent movement of the protective membrane layer and porous support layer in the unbonded region.

Figure 5:
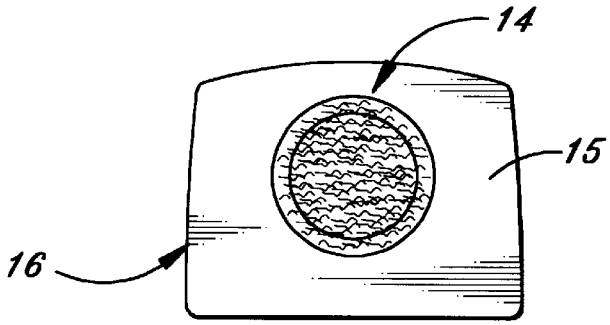
FIG. 5 is a plan view of a protective cover assembly having an acoustic gasket.

FIG. 5 illustrates an acoustically transparent protective cover assembly 14 which further comprises an acoustic gasket 15 selectively bonded to it to form a unitary gasketed protective cover assembly 16.

Figure 6:
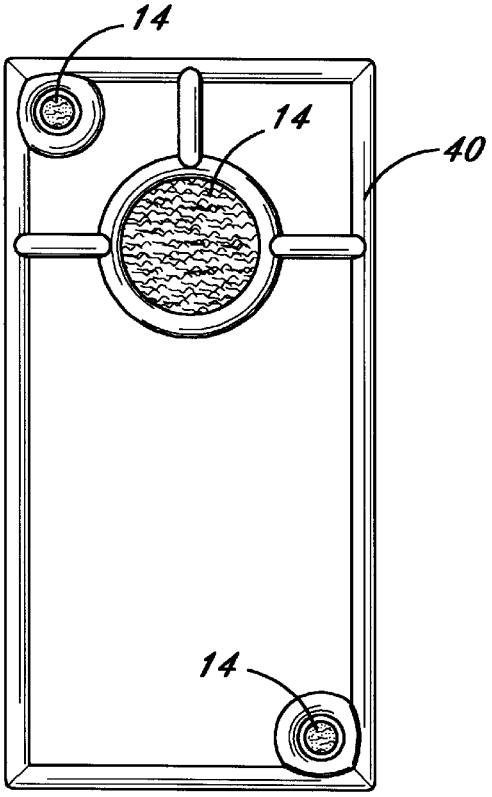
FIG. 6 is a plan view of a protective cover assembly in which the cover material is encapsulated by a molded elastomer gasket.
Figure 6A:
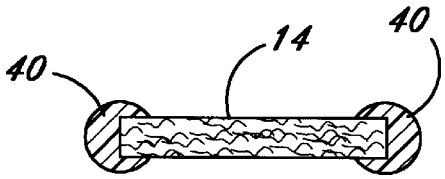
FIG. 6*a* is a partial sectional view of the assembly of FIG. 4.

FIG. 6 illustrates another embodiment of a unitary gasketed protective cover assembly in which the edges and at least a portion of the outer bonded regions of cover assemblies 14 are encapsulated by an acoustic gasket material 40, for example, by an injection-molded rubber or foam rubber.

As the term is used herein, "acoustic gasket" and derivations thereof shall mean a material having properties of absorbing or reflecting sound wave energy when compressed between two surfaces to form a seal. The acoustic gasket can be used in a conventional manner between a transducer and a housing surface, or between surfaces within a housing, to acoustically isolate and dampen vibrations in selected areas.

Conventional commercially-available materials are known in the art and are suitable for use as the acoustic gasket material. For example, soft elastomeric materials or foamed elastomers, such as silicone rubber and silicone rubber foams, can be used. A preferred gasket material is a porous polytetrafluoroethylene material, more preferably, a porous expanded polytetrafluoroethylene material having a microstructure of interconnected nodes and fibrils, as described in U.S. Pat. Nos. 3,953,566; 4,187,390; and 4,110,392; which are incorporated herein by reference. Most preferably, the acoustic gasket material comprises a matrix of porous expanded polytetrafluoroethylene which may be partially filled with elastomeric materials. The acoustic gasket can be bonded to the cover materials using the methods and materials for bonding together the protective membrane and porous support layer described hereinabove.

TEST METHODS

Acoustic Testing

Examples were evaluated for acoustic performance using a commercial analog cellular telephone (Model 1000, sold by Nokia Corp.).

The following test methodology and analysis procedures were employed: IEEE 269-1992 (Standard Methods for Measuring Transmission Performance of Analog and Digital Telephone Sets); IEEE 661-1979 (Method for Determining Objective Loudness Rating of telephone Connections); EIA/IS-19-B (Recommended Minimum Standards for 800 MHz Cellular Subscribers Units); and the CTIA Test plan for 800 MHz AMPS Analog Cellular Subscriber Stations were followed.

The TOLR (Transmission Objective Loudness Rating) and ROLR (Receive Objective Loudness Rating) for the test telephone fitted with protective cover assemblies made in accordance with the present invention were compared to the same telephone with no protective cover assembly (open). This comparison resulted in a Delta TOLR (=[TOLR open—TOLR sample]) and a Delta ROLR (=[ROLR open—ROLR sample]). This procedure provides a simple and accurate method for accurately comparing the overall sound transmission loss resulting from various material systems and sample configurations. The units of the values reported are decibels (dB).

Pore Size and Pore Size Distribution

Pore size measurements may be made by the Coulter Porometer™, manufactured by Coulter Electronics, Inc., Hialeah, Fla.

The Coulter Porometer is an instrument that provides automated measurement of pore size distributions in porous media using the liquid displacement method (described in ASTM Standard E1298-89).

The Porometer determines the pore size distribution of a sample by increasing air pressure on the sample and measuring the resulting flow. This distribution is a measure of the degree of uniformity of the membrane (i.e. a narrow distribution means there is little difference between the smallest and largest pore size.

The Porometer also calculates the mean flow pore size. By definition, half of the fluid flow through the filter occurs through pores that are above or below this size.

Air Permeability

The resistance of samples to air flow was measured by a Gurley densometer manufactured by W. & L. E. Gurley & Sons in accordance with ASTM Test Method D726-84. The results are reported in terms of Gurley Number, or Gurley-seconds, which is the time in seconds for 100 cubic centimeters of air to pass through 1 square inch of a test sample at a pressure drop of 4.88 inches of water.

Water Entry Pressure

The Water entry pressure test provides a test method for water intrusion through membranes. A test sample is clamped between a pair of testing plates. The lower plate is adapted to pressurize a section of the sample with water. A piece of pH paper is placed on top of the sample between the plate on the nonpressurized side as an indicator of evidence for water entry. The sample is then pressurized in small increments, waiting 10 seconds after each pressure change until a color change in the pH paper indicates the first sign of water entry. The water pressure at breakthrough or entry is recorded as the Water Entry Pressure. The test results are taken from the center of the test sample to avoid erroneous results that may occur from damaged edges.

Without intending to limit the scope of the present invention, the apparatus and method of production of the present invention may be better understood by referring to the following examples:

Comparative Example 1

Laminated Construction

This example is a commercially available protective cover material sold under the tradename GORE ALL-WEATHER® VENT, by W. L. Gore & Associates, Inc. The product consists of a nonwoven polyester fabric (0.015" thick, 1.0 oz/yd$^2$, NEXUS® 32900005, from Precision Fabrics Group Co.) laminated to a porous expanded PTFE membrane containing 7.5 wt. % carbon black (KETJENBLACK® EC-300J, from Akzo Corp.) manufactured by W L. Gore & Associates, Inc.. The membrane had the following properties: thickness-0.0007" (18 micrometers); mean flow pore size-3 micrometers; pore volume-89%; air permeability-0.75 Gurley Seconds; water entry pressure-2 psi (13.8 kPa). A disc, 0.32" (8.1 mm) diameter, of the above laminate was cut.

A washer, 0.32" (8.1 mm) outside diameter with a centrally disposed 0.16" (4.05 mm) diameter opening, was cut from a double-sided adhesive tape. The double-sided adhesive tape consists of a 0.001" (25 micrometers) thick layer of pressure-sensitive acrylic adhesive on each side of a 0.002" (50 micrometers) thick Mylar® polyester film (DFM-200-clear V-156, from Flexcon Corp.). One side of the adhesive washer was aligned with and adhered to the porous PTFE membrane layer of the cover material, and the other adhesive side used to attach the cover material to the inside surface of a cellular telephone housing to cover the sound apertures at a microphone mounting location.

Sound transmission through the cover material was tested as described hereinabove. The test results are shown in Table 1.

EXAMPLE 1

Selectively Bonded Construction

The same materials forming Comparative Example 1 were used for this example except that, instead of being laminated together, the nonwoven polyester fabric and porous PTFE membrane were selectively bonded together to form a cover assembly of the invention.

Two 0.32" (8.1 mm) diameter discs were cut, one each from the nonwoven polyester fabric and porous PTFE membrane. The discs were aligned with and bonded together by an adhesive washer described in Comparative Example 1 to form a cover assembly having a centrally disposed unbonded area about 0.16" (4.05 mm)diameter. A second adhesive washer was aligned with and adhered to the other surface of the porous PTFE membrane, and the assembly attached to the cellular telephone housing as described above.

Sound transmission through the cover assembly was tested as described hereinabove. The test results are shown in Table 1.

Comparative Example 2

Laminated Construction

This example is a commercially available protective cover material sold under the tradename GORE ALL-WEATHER® VENT, by W. L. Gore & Associates, Inc. of the same laminate used in Comparative Example 1. A disc, 1.212" (30.8 mm) diameter, of the above laminate was cut.

A washer, 1.212" (30.8 mm) outside diameter with a centrally disposed 0.65" (16.5 mm) diameter opening, was cut from a double-sided adhesive tape (DFM-200-clear V-156, from Flexcon Corp. One side of the adhesive washer was aligned with and adhered to the porous PTFE membrane layer of the cover material, and the other adhesive side used to attach the cover material to the inside surface of a cellular telephone housing to cover the sound apertures at a loudspeaker mounting location.

Sound transmission through the cover material was tested as described hereinabove. The test results are shown in Table 1.

EXAMPLE 2

Selectively Bonded Construction

The same materials forming Comparative Example 2 were used for this example except that, instead of being laminated together, the nonwoven polyester fabric and porous PTFE membrane were selectively bonded together to form a cover assembly of the invention.

Two 1.212" (30.8 mm) diameter discs were cut, one each from the nonwoven polyester fabric and porous PTFE membrane. The discs were aligned with and bonded together by an adhesive washer as described in Comparative Example 2 to form a cover assembly having a centrally disposed unbonded area about 0.65" (16.5 mm) diameter. The second adhesive washer was aligned with and adhered to the other surface of the porous PTFE membrane, and the assembly attached to the cellular telephone housing at a loudspeaker mounting location as described above.

Sound transmission through the cover assembly was tested as described hereinabove. The test results are shown in Table 1.

EXAMPLE 3

Selectively Bonded Construction

The same materials forming Comparative Example 2 were used for this example except that, instead of being laminated together, the nonwoven polyester fabric and porous PTFE membrane were selectively bonded together to form a cover assembly of the invention.

Two 1.212" (30.8 mm) diameter discs were cut, one each from the nonwoven polyester fabric and porous PTFE membrane. The discs were aligned with and bonded together by an adhesive washer 1.212" (30.8 mm) diameter with a centrally disposed 0.325" (8.3 mm) diameter opening to form a cover assembly having a centrally disposed unbonded area about 0.325" (8.3 mm) diameter. The second adhesive washer was aligned with and adhered to the other surface of the porous PTFE membrane, and the assembly attached to the cellular telephone housing at a loudspeaker mounting location as described above.

Sound transmission through the cover assembly was tested as described hereinabove. The test results are shown in Table 1.

TABLE 1

| Example | Cover Assembly unbonded (in.$^2$) | Housing Aperture, (in.$^2$) | Transducer Area, (in.$^2$) | Cover Construction | Sound Loss (dB) |
|---|---|---|---|---|---|
| Comp. Ex. 1 (M) | 0.020 | 0.014 | 0.012 | Laminated | 3.25 |
| Example 1 (M) | 0.020 | 0.014 | 0.012 | Select. Bond | 0.50 |
| Comp. Ex. 2 (S) | 0.332 | 0.031 | 0.096 | Laminate | 16.00 |
| Example 2 (S) | 0.332 | 0.031 | 0.096 | Select. Bond | 0.50 |
| Example 3 (S) | 0.083 | 0.031 | 0.096 | Select. Bond | 7.50 |

Notes:
(M) = Microphone Cover ,
(S) = Speaker Cover

Frequency range for all tests were from 300 to 3000Hz.

Microphone tests were based on TOLR; and speaker tests were based on ROLR.

Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention.

We claim:

1. A sound-transmissive protective cover assembly comprising:

(a) a protective membrane layer having first and second surfaces and a perimeter defined by its edges, (b) a porous support layer having first and second surfaces;

one said surface of each of said protective membrane layer and porous support layer selectively bonded together to form a bonded outer region within said perimeter and, surrounded by said bonded outer region, an unbonded inner region wherein said protective membrane and said porous support material are free to move independently in response to acoustic energy passing therethrough, and thereby minimally attenuating said acoustic energy.

2. The sound-transmissive protective cover assembly as recited in claim 1, wherein the protective membrane layer is a porous membrane.

3. The sound-transmissive protective cover assembly as recited in claim 1, wherein the protective membrane layer is a nonporous film.

4. The sound-transmissive protective cover assembly as recited in claim 2, wherein the protective porous membrane layer comprises a hydrophobic material.

5. The sound-transmissive protective cover assembly as recited in claim 4, wherein the hydrophobic material is polytetrafluoroethylene.

6. The sound-transmissive protective cover assembly as recited in claim 3, wherein the protective nonporous membrane layer comprises a hydrophobic material.

7. The sound-transmissive protective cover assembly as recited in claims 2, 3, 4, 5 or 6, wherein the sound-transmissive support layer is selected from a group consisting of woven material, nonwoven material, and mesh material.

8. The sound-transmissive protective cover assembly as recited in claim 1, further comprising at least one acoustic gasket;

said gasket attached to said assembly so as to not impede independent movement of said protective membrane layer and said porous support layer in said unbonded region.

9. The sound-transmissive protective cover assembly as recited in claim 7 further comprising an acoustic gasket;

said gasket attached to said assembly so as to not impede independent movement of said protective membrane layer and said porous support layer in said unbonded region.

10. The sound-transmissive protective cover assembly as recited in claim 8, wherein said gasket is a porous material comprised at least in part of polytetrafluoroethylene.

11. The sound-transmissive protective cover assembly as recited in claim 8 wherein said gasket comprises an elastomeric material.

12. The sound-transmissive protective cover assembly as recited in claim 9 wherein said gasket comprises an elastomeric material.

13. The sound-transmissive protective cover assembly as recited in claim 11 wherein said elastomeric material is a silicone rubber.

14. The sound-transmissive protective cover assembly as recited in claim 12 wherein said elastomeric material is a silicone rubber.

15. The sound-transmissive protective cover assembly as recited in claim 13 wherein said elastomeric material is molded so as to encapsulate said edges and bond to said bonded outer region of said cover layers.

16. The sound-transmissive protective cover assembly as recited in claim 14 wherein said elastomeric material is molded so as to encapsulate said edges and bond to said bonded outer region of said cover layers.

17. A sound-transmissive protective cover assembly comprising:

(a) a protective membrane layer having first and second surfaces and a perimeter defined by its edges, (b) a porous support layer having first and second surfaces, and (c) at least one acoustic gasket;

one said surface of each of said protective membrane layer and porous support layer selectively bonded together to form a bonded outer region within said perimeter and, surrounded by said bonded outer region, an unbonded inner region wherein said protective membrane and said porous support material are free to move independently in response to acoustic energy passing therethrough;

said at least one gasket attached to at least one said layer so as to not impede independent movement of said protective membrane layer and said porous support layer in said unbonded region;

whereby a protective cover assembly which substantially prevents passage of acoustic energy through said gasket and which minimally attenuates acoustic energy passing through said unbonded region is provided.

* * * * *

UNITED STATES PATENT AND TRADEMARK OFFICE

CERTIFICATE OF CORRECTION

PATENT NO. : 5,828,012

DATED : October 27, 1998

INVENTOR(S) : Damian I. Repolle, Frank S. Principe

It is certified that error appears in the above-identified patent and that said Letters Patent is hereby corrected as shown below:

Column 4, line 55, after "12 to 38" add "micrometers."

Signed and Sealed this

Twenty-third Day of February, 1999

*Attest:*

Q. TODD DICKINSON

*Attesting Officer*

*Acting Commissioner of Patents and Trademarks*